US006708018B2

(12) United States Patent
Sato et al.

(10) Patent No.: US 6,708,018 B2
(45) Date of Patent: Mar. 16, 2004

(54) IMAGE FORMING APPARATUS AND SHEET FEEDING METHOD FOR USE IN THE IMAGE FORMING APPARATUS

(75) Inventors: Hiroyasu Sato, Hachioji (JP); Ken Nonaka, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/147,139

(22) Filed: May 16, 2002

(65) Prior Publication Data

US 2002/0176725 A1 Nov. 28, 2002

(30) Foreign Application Priority Data

May 25, 2001 (JP) ..... 2001-156874

(51) Int. Cl.[7] ..... G03G 15/00
(52) U.S. Cl. ..... 399/396; 399/388
(58) Field of Search ..... 399/16, 23, 381, 399/388, 394, 396; 271/226, 227

(56) References Cited

U.S. PATENT DOCUMENTS 5,072,924 A * 12/1991 Sugiyama ..... 271/227 X
6,148,172 A * 11/2000 Kanda et al. ..... 399/396 X
6,311,039 B1 * 10/2001 Funamizu et al. ..... 399/394
6,397,035 B2 * 5/2002 Kataoka et al. ..... 399/388

* cited by examiner

*Primary Examiner*—Sandra Brase
(74) *Attorney, Agent, or Firm*—Muserlian, Lucas & Mercanti

(57) ABSTRACT

In an image forming apparatus which has a primary sheet feeder, a secondary sheet feeder for conveying a recording sheet which is fed from the primary sheet feeder to an image forming position in timed relationship with image formation, and a controller for controlling the primary sheet feeder and the secondary sheet feeder, the controller selects long and short two kind of sheet feed intervals according to a detection signal of a recording sheet detector provided upstream of the secondary sheet feeder.

7 Claims, 5 Drawing Sheets

IMAGE FORMING APPARATUS AND SHEET FEEDING METHOD FOR USE IN THE IMAGE FORMING APPARATUS

BACKGROUND OF THE INVENTION

The present invention relates to an image forming apparatus to form an image onto a recording sheet, and particularly, to a sheet feeding control technology in the image forming apparatus.

In the image forming apparatus to form an image by an electro-photographic method, inkjet method, or heat sensitive method, as a technology to shorten the time necessary for forming one sheet of an image, there are a means to increase the conveying speed of the recording sheet in the image forming process, and a means to shorten an interval between the conveying start times of the preceding conveyed recording sheet and the following conveyed recording sheet, that is, to shorten the sheet feed interval.

As one of specifications of the image forming apparatus, there is CPM (Copy Per Minute) or PPM (Print Per Minute). The number of sheets on which the image can be formed onto A4 sized recording sheets in the continuous image formation for one minute are used in many cases for the CPM or PPM. Hereinafter, the CPM and PPM are generally called the image forming speed.

In the development of the image forming apparatus, initially a target image forming speed is set, and each condition of each section of the image forming apparatus or image forming process is designed so that the target image forming speed can be attained.

In this connection, although the image forming speed is determined by the conveying speed of the recording sheet in the image forming process, in many image forming apparatus, as the conveying speed, the lower value as possible is used. Accordingly, the sheet feed interval is set to a value which is shortened to the limit.

This is for the reason why the conveying speed relates to the moving speed of a photoreceptor, the writing speed of the image, and the operation speed of the whole image forming apparatus including the fixing speed, and because the increase of the conveying speed is the increase of the operation speed of the whole image forming apparatus, from the view points of cost reduction or the assurance of the stability of the operation, it is preferable that the conveying speed is set lower.

However, in the conventional technology, because it is difficult that the sheet feed interval is shortened more than a certain time, a case where the target image forming speed can not be attained, or a case where it is necessary to adopt a means by which the conveying speed is increased in order to attain the target image forming speed, is generated. As described above, in order to attain the target image forming speed, when the means by which the conveying speed is increased is adopted, it is not preferable because the operation speed of whole the image forming apparatus is increased.

Particularly, in the improvement to increase the image forming speed in the partial improvement when the improved machine of the machine which is provided in the market is developed, because the improvement method of the image forming speed by the shortening of the sheet feed interval can not be adopted, there are many cases where it is difficult that the target image forming speed is attained.

SUMMARY OF THE INVENTION

An object of the present invention is to solve the above described problems in the conventional technology to increase the image forming speed, and to provide an image forming apparatus in which the conveying speed is set to a low value and further the high image forming speed is shown, and a sheet feed method in the image forming apparatus.

The object of the present invention can be attained by any one of the following Structures (1)–(8).

(1) An image forming apparatus which has the primary sheet feed means, and secondary sheet feed means for conveying the recording sheet which is fed from the primary sheet feed means to the image forming position in timed relationship with the image formation, and a control means for controlling the primary sheet feed means and the secondary sheet feed means, the image forming apparatus is characterized in that: the control means selects the long and short two kind of sheet feed intervals according to the detection signal of a recording sheet detection means provided at the upstream of the secondary sheet feed means in the control.

(2) An image forming apparatus according to the above (1), wherein the control means conduct the control by using a short sheet feed interval when it is detected that the recording sheet is fed at the arrival time within the range of a portion of a faster side in the fluctuation of the secondary sheet feed arrival time at which the recording sheet arrives at the secondary sheet feed means, and conducts the control by using a long sheet feed interval when the recording sheet is fed at the arrival time outside said range of the portion of the faster side and within a range of allowable fluctuation.

(3) An image forming apparatus according to the above (1) or (2), wherein the control means conducts the control so that the integer value in which the image forming speed calculated from the two kind of sheet feed intervals is rounded to the nearest whole number, coincides with the target image forming speed value.

(4) An image forming apparatus according to any one of the above (1) to (3), wherein the control means controls the secondary sheet feed means so that the recording sheet is fed at the two kind of the sheet feed intervals, and controls the first sheet feed means on the basis of the control of the secondary sheet feed means.

(5) A sheet feed method in the image forming apparatus in which the recording sheet is conveyed from the accommodation means by the primary sheet feed means to the secondary sheet feed means, and the recording sheet is fed to the image forming position by being conveyed by the secondary sheet feed means, the sheet feed method in the image forming apparatus is characterized in that: as the sheet feed interval when the recording sheet is fed to the image forming position, the long and short two kind of sheet feed intervals are used, and when the recording sheet is fed at the arrival time within the range of a portion of a faster side in the fluctuation of the arrival time at which the recording sheet arrives at the secondary sheet feed means, the recording sheet is fed at the short sheet feed interval, and when the recording sheet is fed at the arrival time outside said range of the portion of the faster side and within the allowable fluctuation range, the secondary sheet feed means conducts the sheet feed at the long sheet feed interval.

(6) A sheet feed method in the image forming apparatus according to the above (5), wherein the leading edge of the recording sheet is detected on the upstream side of the secondary sheet feed means, and by the control according to the leading edge detection signal, the secondary sheet feed means conducts the sheet feed.

(7) A sheet feed method in the image forming apparatus according to the above (5) or (6), wherein the primary sheet feed means conducts the sheet feeding according to the detection signal.

(8) A sheet feed method in the image forming apparatus according to any one of the above (5) to (7), wherein the primary sheet feed means operates on the basis of the operation of the secondary sheet feed means.

DETAILED DESCRIPTION OF THE PREFERRED EMBODIMENT (Structure of an Image Forming Apparatus)

Figure 1:
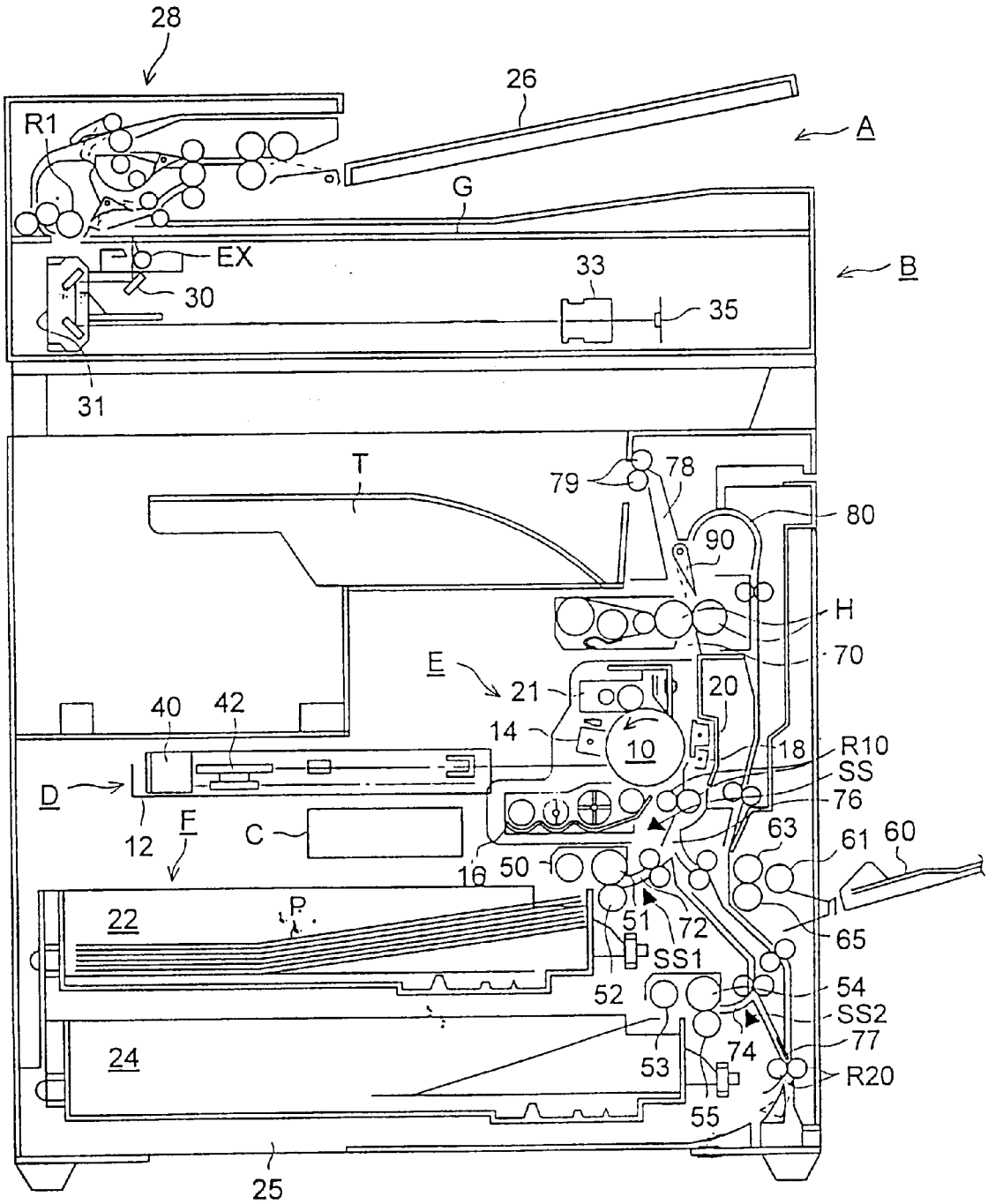
FIG. 1 is a view showing the whole structure of an image forming apparatus according to an embodiment of the present invention.

Referring to FIG. 1, the image forming apparatus according to an embodiment of the present invention will be described below.

FIG. 1 is a view showing the whole structure of a digital image forming apparatus (hereinafter, simply called the image forming apparatus).

In the drawing, the image forming apparatus has: an automatic document conveying apparatus A; a document image reading section B to read an image of a document conveyed by the automatic document conveying apparatus A; an image control substrate C to process a read document image; a writing section D including a writing unit 12 to write the data onto a photoreceptor 10 according to the data after the image processing; an image forming section E including an image forming means such as the photoreceptor 10, a charging electrode 14 around it, developing means 16 composed of a magnetic brush type development apparatus, transfer apparatus 18, separation apparatus 20, and cleaning apparatus 21; an accommodation section F for a plurality of accommodation means 22, 24, such as trays to accommodate the recording sheet P (hereinafter, called the sheet feed tray, or simply called tray).

The automatic document conveying apparatus A has a document convey processing section 28 including a document table 26, roller group including a roller R1, and switching means (no reference sign) to appropriately switch the moving path of the document, as a main element.

The document image reading section B is located below a platen glass G, and composed of two mirror units 30, 31 which can reciprocally move with the optical path length, fixed lens 33, and line CCD 35, and the writing section D is composed of a laser light source 40, and polygonal mirror (polarizing unit) 42.

A fixing means H is structured by, in the embodiment, a roller housing a heat source, and a pressure contact roller which is rotated while being brought into pressure contact with the roller.

In the above structure, a process by which a toner image is formed on the photoreceptor 10 and after it is transferred onto the recording sheet, it is delivered onto a sheet delivery tray, is, generally, as follows.

One of the document sheets (not shown) placed on the document table 26 is conveyed in the document convey processing section 28, and during the passage below the roller R1, a slit exposure is conducted by an exposure means EX.

The reflected light from the document is focused onto the CCD 35 through the mirror units 30, 31 and lens 33, which are placed on the fixed position, and an image is read.

The image information read by the document image reading section B is processed by the image processing means, and encoded and stored in a memory provided on the image control substrate C.

The image data is read out at the time of the image formation, and according to the image data, a laser light source 40 in the writing section D is driven, and the exposure is conducted onto the photoreceptor 10.

Onto the photoreceptor 10 rotated in the arrowed direction (counterclockwise), after a predetermined surface potential is given by the corona discharging action of the charging electrode 14, an electrostatic latent image is formed onto the photoreceptor drum 10 by the exposure as described above.

The formed electrostatic latent image is reversal developed by the developing means 16, and is made a toner image.

The toner image is transferred onto the recording sheet P conveyed from the registration roller R10 as the secondary sheet feed means by the transfer unit 18 in timed relationship with the image formation onto the photoreceptor 10. The toner image on the recording sheet P is fixed by a fixing means H, and the recording sheet P after the fixing, is conveyed on a sheet delivery path 78, and by a sheet delivery roller 79, delivered onto a sheet delivery tray T.

In the embodiment, the sheet feed trays 22, 24 are arranged on 2 stages of the upper and lower directions, however, the more number of trays than that, can also be provided. In the sheet feed trays, a space portion 25 with a predetermined gap is formed between a bottom portion of the sheet feed tray 24 arranged on the lower stage and a bottom wall of the apparatus main body. The space portion 25 is used in a mode in which the images are formed on both surfaces of the recording sheet, and the conveying path on which the front and the rear of the recording sheet P are reversed, is formed together with the second conveying path 80 (which will be described later) for the front and rear reversing of the recording sheet.

Numerals 50 and 53 shown in the upper portion of the respective leading edge portions (viewed in the sheet feed direction, corresponding to the leading edge of the accommodated recording sheet P) of the sheet feed trays 22 and 24 are feed rollers as the primary sheet feed means, numerals 51 and 54 are separation conveying rollers, and numerals 52 and 55 are double feed prevention rollers.

Numeral 60 is a manual bypass sheet feed tray provided to a manual bypass sheet feed section, and structured in such a manner that the lower end is made a fulcrum and can be opened and closed to the main body side wall of the image forming apparatus 1.

Numeral 61 is a feed roller to feed the recording sheet placed on the manual bypass sheet feed tray 60 according to the image formation, numeral 63 is a separation conveying roller provided downstream the feed roller 61, and numeral 65 is a double feed prevention roller to prevent the feeding of a plurality of recording sheets P, and has the same function as the sheet feed means provided corresponding to the sheet feed trays 22 and 24.

Numeral 70 is the first conveying path to conduct the image formation (image recording) by the transferring onto the recording sheet P, and extends from the lower side to the upper side.

Numeral 72 is a sheet feed path for the recording sheet accommodated in the upper stage sheet feed tray 22, numeral 74 is a sheet feed path for the recording sheet accommodated in the lower stage sheet feed tray 24, and numeral 76 is a combined portion at which the recording sheets P fed from both trays 22 and 24 join (a portion of the first conveying path 70).

Numeral 78 is a sheet delivery path to delivery the recording sheet on which a predetermined image is formed, onto the sheet delivery tray T.

Numeral 80 is the second conveying path for the front and rear reversing of the recording sheet to be used when the image formation is conducted on the both surfaces of the recording sheet, and in the upper portion of the drawing, it communicates with the first conveying path.

The second conveying path 80 extends from the upper portion toward the lower portion. Further, the lower end portion of the second conveying path 80 is a conveying path extending almost vertically, and the lower end extends more below than the sheet feed portion (the position of the above sheet feed apparatus) of the lower stage sheet feed tray 24, and is connected to the first conveying path 70.

As can be understood from the above description, the first conveying path 70 and the second conveying path 80 form a long loop in the longitudinal direction on one side wall side of the apparatus main body.

At the connection portion of the first conveying path 70 and the second conveying path 80, a reversal conveying roller R20 is provided.

The connection portion can also be said as a branch portion at which the both conveying paths are branched, because the recording sheet P is not continuously conveyed from the second conveying path 80 to the first conveying path 70.

Numeral 90 is a (upper side) branch guide, and the recording sheet P on whose first surface the image is formed, is controlled so as to be conveyed to the sheet delivery path 78, or to the second conveying path 80.

When a mode to form the image onto both surfaces of the recording sheet P, is set, the branch guide 90 is positioned in the dotted line position of the drawing so that the recording sheet P on whose first surface the image is formed, and the transfer toner image is formed, is conveyed to the second conveying path 80, and after the recording sheet is conveyed to the second conveying path 80, it is controlled through the control section, not shown, so that it positions in a solid line position.

In the image forming process, when the recording sheet P conveyed on the second conveying path 80 is sent to the space portion 25, the recording sheet P is accommodated in the space portion 25 in the condition that its trailing edge is held by the reversal conveying roller R20.

The image forming process onto the second surface of the recording sheet in the image forming apparatus having the above structure, is as follows.

As described above, the recording sheet P on whose first surface the image is formed, is elevated upward on the first conveying path 70, and when its leading edge arrives at the branch guide 90, because the branch guide 90 is held at the dotted line position in the drawing, the recording sheet P enters into the second conveying path 80, and continues the movement. The entrance portion of the second conveying path 80 is moderately circular-arced, and the smooth movement of the recording sheet P is assured. When the recording sheet P moves downward on the second conveying path 80, and arrives at its lower end, the recording sheet P is conveyed by the reversal conveying roller R20, and enters into the space 25.

At the time point when the trailing edge of the recording sheet P arrives at the vicinity of the reversal conveying roller R20, the rotation direction of the reversal conveying roller R20 is reversed, and the end portion which is the trailing edge, is made a forefront, and the recording sheet P is conveyed upward. The recording sheet P is sent into the first conveying path 70, in the condition that the non-image formation side of recording sheet P is faced to the photoreceptor 10, and the leading edge is restricted by the registration roller R10.

On the one hand, on the photoreceptor 10, the second toner image is formed by the above described process, and when the registration roller R10 is started to be rotated in timed relationship with the rotation of the photoreceptor 10, the recording sheet P enters into a transfer area in the condition that the recording sheet P is superimposed by the second toner image area.

Hereinafter, the leading edge of the recording sheet P on which the transfer processing, separation processing, and fixing processing are conducted, arrives at a portion at which the branch guide 90 exists, the branch guide 90 is held in the solid line position of the drawing, and the first conveying path 70 and the sheet delivery path 78 are made communication condition, and because the communication with the second conveying path 80 is stopped, the recording sheet P enters into the sheet delivery path 78, and is delivered onto the sheet delivery tray T through the sheet delivery roller 79.

In this connection, in the connection portion at the lower end portion of the first conveying path 70 and the second conveying path 80, when the movement of the recording sheet which moves downward on the second conveying path 80 is allowed, and the recording sheet after the front and rear is reversed, is sent into the first conveying path 70, a regulation plate 77 is provided to prevent the recording sheet from falsely entering into the second conveying path 80.

The regulation plate 77 is formed of polyethylene terephthalate (PET) base, however, when it is a material by which the function can be performed, the material may be basically any one, but from the view point of easiness of handling, or durability, plastic sheet is preferable.

(The Conventional Sheet Feed Control)

Next, referring to FIG. 2, the setting of the conventional sheet feed interval will be described.

Figure 2:
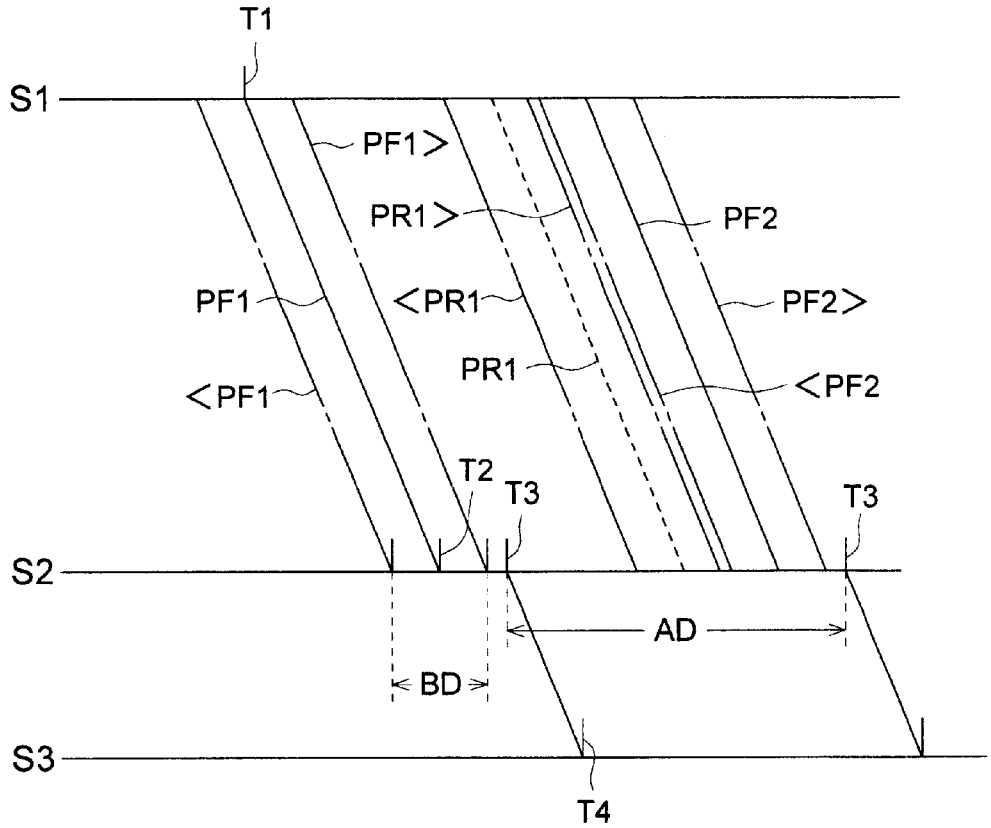
FIG. 2 PRIOR ART
FIG. 2 s a time chart showing the conventional sheet feed control.

FIG. 2 is a time chart showing the conveying process of the recording sheet in the image forming apparatus of the conventional electro-photographic system, and in the drawing, the vertical axis shows the conveying distance and the horizontal axis shows the time, respectively.

Symbol S1 shows the primary sheet feed position at which the primary sheet feed means (feed rollers 50, or 53 in FIG. 1) feeds the recording sheet from the accommodation section, and symbol S2 shows the secondary sheet feed position at which the secondary sheet feed means (registration roller Rio in FIG. 1) feeds the recording sheet, and symbol S3 shows a transfer position at which the transfer unit 18 conducts the transfer.

The sheet feed interval AD is the time length between the start time T3 of the preceding recording sheet PF1 at the secondary sheet feed position S2 and the start time T3 at the secondary sheet feed position S2 of the subsequent recording sheet PF2.

In the continuous image forming process, because the control to eliminate the useless vacant interval between the recording sheets is conducted, the time at which the passage time of the recording sheet is added by a fluctuation of the time at which the recording sheet arrives at the secondary sheet feed position S2, is set as the sheet feed interval AD.

That is, as the sheet feed interval AD, even when there is the fluctuation in the arrival time, it is set to a value so that the leading edge <PF2 of the subsequent recording sheet does not pass the trailing edge PR1> of the preceding recording sheet. In this connection, "<" in the above description and FIG. 2, shows the slowest travel locus in the fluctuation of the travel time, and ">" shows the fastest travel locus in the fluctuation of the travel time.

Such the sheet feed interval AD is expressed by the following expression (1).

$$AD=L/V+BD \quad (1)$$

where L is the length in the conveying direction of the recording sheet, and V is the conveying speed of the recording sheet. BD is a fluctuation allowable time for satisfying the condition as described above, and it is mainly set considering the fluctuation of the arrival time of the recording sheet at the secondary sheet feed position S2. The fluctuation allowable time BD is, as shown in the expression (1), a time corresponding to the between-sheet interval formed between the continuously fed recording sheet and the recording sheet.

Figure 3:
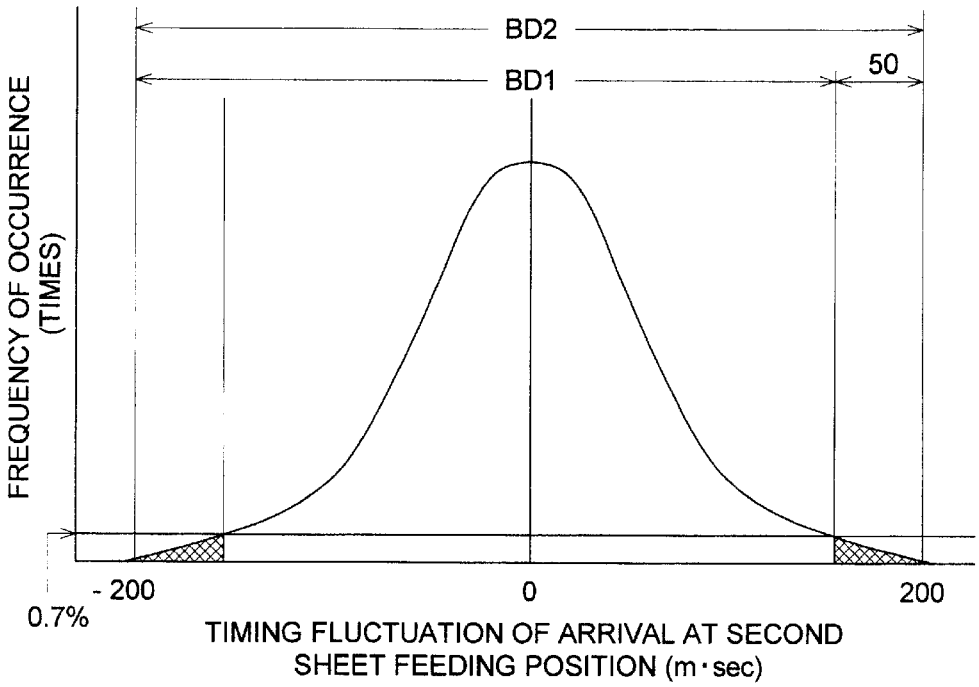
FIG. 3 is a graph showing the distribution of the fluctuation of the secondary sheet feed arrival time.

FIG. 3 is an example of the distribution of the fluctuation of the secondary sheet feed arrival time T2 measured at the secondary sheet feed position S2. Conventionally, in order to secure the reliability of the image forming apparatus, the fluctuation allowable time BD is made the width of the fluctuation allowable time BD2 so that the frequency at which the arrival is measured is zero. For example, in FIG. 3, BD=400 m·sec.

In the conventional sheet feed control as described above, as the fluctuation allowable time BD, as shown in FIG. 3, a value including the whole range of the fluctuation of the secondary sheet feed arrival time T2 is set. In this connection, as the sheet feed interval, when it is a value which satisfies AD>L/V+BD, there is no problem in the sheet feed.

(The Sheet Feed Control in the Embodiment of the Present Invention)

Next, the embodiment of the present invention will be described.

In the present embodiment, as the sheet feed interval AD, 2 kind of the sheet feed intervals AD1, AD2 expressed by the following expressions (2) and (3) are set.

$$AD1=L/V+BD1 \quad (2)$$

$$AD2=L/V+BD2 \quad (3)$$

In the embodiment of the present invention, when the sheet feed control by using such the long and short two kind of sheet feed intervals is conducted, without changing the conveying speed of the recording material, the image forming speed can be effectively increased.

As described above, conventionally, although one kind of fluctuation allowable time is used, when two kinds of fluctuation allowable time are used, the sheet feed interval can be reduced and the image forming speed can be increased. Particularly, when the fluctuation allowable time BD2 is set as the same as the conventional fluctuation allowable time BD, and the fluctuation allowable time BD1 is made smaller value than the conventional fluctuation allowable time, the image forming speed can be effectively increased.

In the design work of the image forming apparatus, in the design work of each section of each condition to determine the specification of the image forming apparatus, although each kind of setting is conducted so as to coincide with the target image forming speed, according to the sheet feed method of the present embodiment, the target image forming speed can be attained at the low recording sheet conveying speed.

In the above expressions (2) and (3), the fluctuation allowable time BD1 is a range in which, for example, as 99%, it includes the largest half, or the almost all portion of the frequency at which the fluctuation of the secondary sheet feed position arrival time is generated, and when the sheet feed interval using the reduced fluctuation allowable time BD1 is set, the image forming speed is increased.

In FIG. 3, the value of the fluctuation allowable time BD1 is defined to a range showing the generation probability of the fluctuation more than 0.7%. Thereby, the fluctuation allowable time BD1, in other words, the sheet feed interval is reduced by the fluctuation allowable time 50 m·sec. According to the sheet feed interval, for example, when the image forming speed is 40 sheets, the image forming speed is increased by about 3.3%. Such the increase of the image forming speed is, in the various means conducted in order to attain the target image forming speed, very effective means in a point in which it can be conducted without influencing onto other conditions in the image forming process.

As a process by which the specification of the sheet feed system of the image forming apparatus according to the present embodiment, is determined, there are stages in which: as the first stage, each condition of the image forming process and the recording sheet conveying speed is determined to the target image forming speed, and the image forming apparatus is produced; as the second stage, the image forming apparatus is operated, and the fluctuation of the secondary sheet feed arrival time T2 and the sheet feed interval are measured; as the third stage, the setting of the image forming speed as the final target, and the setting of the fluctuation allowable time BD1 to attain the target image forming speed and the sheet feed interval AD1 are conducted. The setting of the fluctuation allowable time BD1 is conducted as follows.

When the generation probability of the sheet feed out of the range of the short fluctuation allowable time BD1 is α, by using the image forming speed (CPM1 which is also the target image forming speed) calculated from the fluctuation allowable time BD1 and the sheet feed interval AD1, and the fluctuation allowable time BD2 including the whole range of the fluctuation, and the image forming speed (CPM 2) calculated from the long sheet feed interval AD2 corresponding to that, the CPMT which is the whole image forming speed is expressed by the following expression (4).

$$CPMT=CPM1\times(1-\alpha)+CPM2\times\alpha \quad (4)$$

In the expression (4), the CPM1 calculated from the fluctuation allowable time BD1 is the target image forming speed, and in the case where the CPMT which is the whole image forming speed is calculated in such a manner that the CPMT is rounded to the nearest whole number below the decimal point, when the value in which the CPMT is made an integer coincides with the target image forming speed, the desired object can be attained.

When the generation frequency of the sheet feed shown in FIG. 3 is applied to the expression (4), the following expression (5) is obtained, and for example, it can be seen that the target CPM of 40 sheets is attained.

$$CPM1\times(1-\alpha)+CPM2\times\alpha=(60000/1330)\times0.993+[60000/(1330+50)]\times0.007=45.10 \quad (5)$$

As shown by the expression (5), the CPMT which is the whole CPM, is 45.10 sheets, and it can be seen that the target CPM of 45 sheets is attained.

This calculation result shows that the target CPM is attained by only changing the sheet feed interval without changing the other conditions, and shows that the sheet feed method according to the present embodiment is very effective as the means to attain the target image forming speed.

Figure 4:
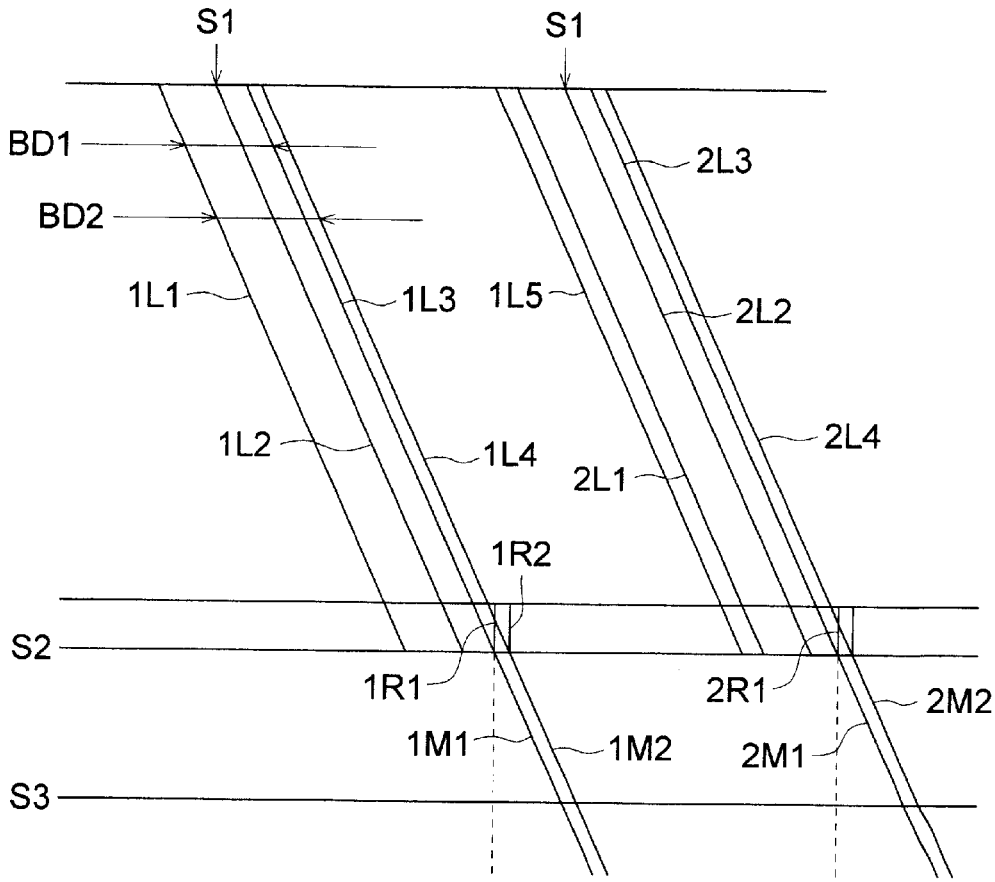
FIG. 4 is a time chart showing the sheet feed control in the image forming apparatus according to the embodiment of the present invention.
Figure 5:
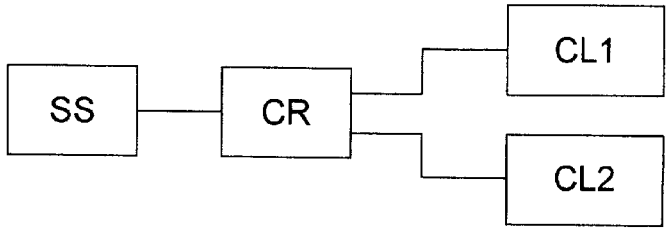
FIG. 5 is a block diagram of a control system to conduct the sheet feed control.

Referring to FIG. 4, the sheet feed control according to the setting of the sheet feed interval as described above will be described below. FIG. 4 is the same time chart as FIG. 2, and the vertical axis respectively shows the traveling position of the recording sheet, and the horizontal axis shows the time. FIG. 5 is a block diagram of the control system to conduct the control of FIG. 4.

In the example of FIG. 4, the sheet feed positions of two stages are provided, and the recording sheet is fed from the lower stage primary sheet feed position S1 (lower) and the upper stage primary sheet feed position S1 (upper) The (SS) is the recording sheet detection position provided just upstream the secondary sheet feed position S2. The S1 (upper) is a position of the feed roller 50 in FIG. 1, and the S1 (lower) is a position of the feed roller 53 in FIG. 1. Further, the S2 is a position of the registration roller R10, and the S3 is a transfer position by the transfer unit 18. The 1L1 to 1L5 respectively show the travel locus of the leading edge or trailing edge from the primary sheet feed position S1 of the first recording sheet, the 2L1, and 2L4 show the travel locus of the leading edge from the primary sheet feed position S1 of the second recording sheet, the 1M1, 1M2 show the travel locus of the leading edge from the secondary sheet feed position S2 of the first recording sheet, and the 2M1, 2M2 show the travel locus of the leading edge from the secondary sheet feed position S2 of the second recording sheet. The 1L2 and 1M1 show the travel locus of the recording sheet supposed as the reference.

In FIG. 5 which is a block diagram of the control system, the CR is a control means, and conducts the sheet feed control as will be described below. The SS is, as shown in FIG. 1, a registration sensor as the recording sheet detection means arranged just upstream the registration roller R10. The CL1 is a primary sheet feed clutch to conduct the switching of the drive/stop of the feed roller 50 and separation conveying roller 51, or the feed roller 53 and separation conveying roller 54, and a drive means of the primary sheet feed means is composed of a drive motor (not shown) and the clutch CL1. The CL2 is a clutch of the secondary sheet feed to conduct the switching of the drive/stop of the registration roller R10, and a drive means of the secondary sheet feed means is structured by a drive motor (not shown) and the clutch CL2.

In this connection, as the recording sheet detection means, it is not limited to the registration sensor SS, but may be a sensor provided on the upstream side of the secondary sheet feed means, and it can be arranged at an arbitrary position between the primary sheet feed position S1 and the secondary sheet feed position S2, and for example, as the SS1 and SS2 in FIG. 1, it may also be provided just downstream the separation conveying rollers 51 and 54. By these sensors SS, SS1, and SS2, the leading edge passage time of the recording sheet is detected, and when the travel time of the recording sheet from the sensor to the secondary sheet feed position is added, the secondary sheet feed arrival time is obtained.

In the present embodiment, although the sheet feed interval is set by the reduced fluctuation allowable time BD1 in which the fluctuation of the secondary sheet feed arrival time T2 is reduced, and the fluctuation allowable time BD2 (a range including the whole range of the fluctuation) in which a predetermined value is added to the reduced fluctuation allowable time BD1, in FIG. 4, the 1L1 and 2L1 are the fastest recording sheet travel locus of the leading edge, and the 1L4 and 2L4 are the latest recording sheet travel locus of the leading edge, and further, the 1L3 is supposed as the boundary between the time within the range of the fluctuation of the reduced secondary sheet feed arrival time T2, and the time out of the range of the reduced fluctuation.

Such the recording sheet travel locus in FIG. 4 corresponds to the sheet feed interval and the fluctuation allowable time as follows.

$$AD=1L2-2L2,\ BD=BD2=1L1-1L4,\ BD1=1L1-1L3.$$

The passage timing of the leading edge and trailing edge of the recording sheet is, in the recording sheet detection position (SS), detected by the registration sensor SS (shown in FIG. 1) as the recording sheet detection means. Accordingly, the whole of the sheet feed interval AD, fluctuation allowable times BD, BD1 and BD2 are obtained from the detection result of the registration sensor SS.

In the present embodiment, the leading edge of the recording sheet which arrives at the second sheet feed position S2 is detected, and it is judged whether the recording sheet travels within the range of BD1=1L1−1L3, or within the range of BD2=(1L1−1L3)+(1L3−1L4), or travels later than the 1L4.

When it is judged that the recording sheet travels within the range of the 1L1–1L3, it is processed as the normal sheet feed, and in the secondary sheet feed, the clutch CL2 is driven at the timing of the sheet feed interval AD1, and it is controlled so that that the secondary sheet feed 1R1 is conducted and the recording sheet travels on the locus of 1M1.

When it is judged that the recording sheet travels within the range of the 1L3–1L4, it is processed as the late sheet feed, and the secondary sheet feed 1R2 is conducted at the timing of the sheet feed interval AD2 (in FIG. 3, 50 m·sec later than the normal sheet feed).

The control to form the sheet feed interval AD2 which is a long sheet feed interval, is conducted on the recording sheet fed at the later arrival time within the fluctuation allowable range, however, when it is detected that the next recording sheet to the recording sheet fed at the long sheet feed interval AD2, is fed at the short fluctuation allowable range BD1, the long sheet feed interval AD2 is not made a reference, and the clutch CL2 is started at the timing at which the normal sheet feed interval AD1 is formed, and the secondary sheet feed is conducted.

The control of the clutch CL1 to drive the primary sheet feed means is conducted on the basis of the control of the secondary sheet feed means. That is, the start control of the clutch CL1 to convey the recording sheet is conducted on the basis of the start of the clutch CL2.

Figure 6:
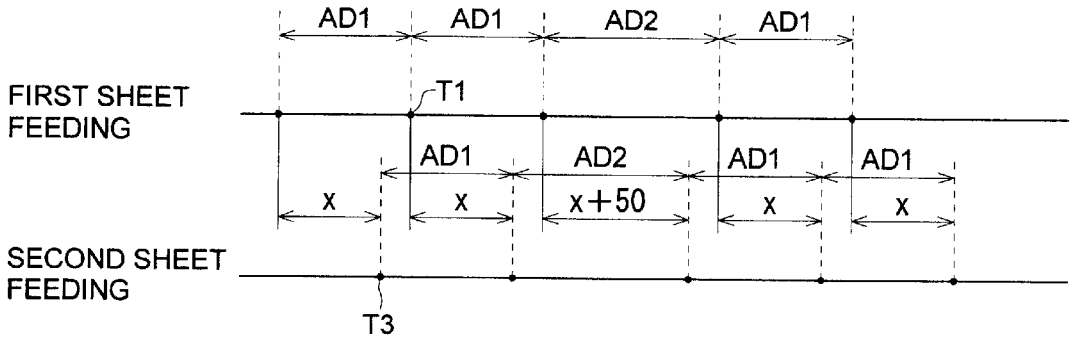
FIG. 6 is a time chart of the primary and secondary sheet feed controls.

FIG. 6 is a timing chart of the primary and secondary sheet feed control. As shown in the drawing, the base of the of the sheet fed control is the secondary sheet feed control to form the sheet feed interval AD1, and the primary sheet feed control is conducted on the basis of the secondary sheet feed control, and the long sheet feed interval AD2 is applied only to the recording sheet on which a late sheet feed is conducted. That is, only when the late sheet feed is conducted, the primary sheet feed T1 is determined according to the secondary sheet feed time T3.

As described above, when the sheet feed control by which the long sheet feed interval AD2 is applied is conducted only on the late sheet feed in which the generation frequency is low, the image forming speed can be effectively increased. Such the increase method of the image forming speed is, in the development by which a portion of the image forming apparatus is improved, without the change of the operation speed of each portion constituting the image forming apparatus such as the travel speed of the photoreceptor, writing speed of the exposure apparatus, transfer speed of the transfer unit, and operation speed of the developing unit, the image forming speed can be elevated to the target value, and vary effective in the partial improvement.

According to any invention of the Structures (1)–(8), without increasing the operation speed of the whole image forming apparatus such as the conveying speed of the recording sheet and the travel speed of the photoreceptor, because the image forming speed can be increased by only changing the sheet feed interval, the adjustment to attain the set target CPM or PPM or the change of the image forming speed can be easily conducted.

In the partial improvement to increase the image forming speed, the means for changing only the sheet feed interval is particularly effective.

What is claimed is:

1. An image forming apparatus comprising:

(a) a primary sheet feeder for feeding a recording sheet from a sheet accommodation tray;

(b) a secondary sheet feeder for conveying the recording sheet fed from the primary sheet feeder to an image forming position in timed relationship with image formation;

(c) a recording sheet detector provided upstream of the secondary sheet feeder for detecting the recording sheet fed by the primary sheet feeder; and (d) a controller for controlling the primary sheet feeder and the secondary sheet feeder;

wherein the controller selects either a long or a short sheet feed interval of a feed start timing between a preceding recording sheet and a following recording sheet, according to a detection signal of the recording sheet detector, and wherein an arrival time within a range on a faster side of fluctuation of a secondary sheet feed arrival time at which the preceding recording sheet arrives at the secondary sheet feeder, and the short sheet feed interval, satisfy the condition that an integer value in which an image forming speed calculated from the long and short sheet feed intervals is rounded to a nearest whole number, coincides with a target image forming speed value.

2. The image forming apparatus of claim 1, wherein when the preceding recording sheet is fed at the arrival time within the range on the faster side of the fluctuation of the secondary sheet feed arrival time, the controller selects the short sheet feed interval, and when the preceding recording sheet is fed at an arrival time outside the range of the faster side and within a range of allowable fluctuation, the controller selects the long sheet feed interval.

3. An image forming apparatus comprising:

(a) a primary sheet feeder for feeding a recording sheet from a sheet accommodation tray;

(b) a secondary sheet feeder for conveying the recording sheet fed from the primary sheet feeder to an image forming position in timed relationship with image formation;

(c) a recording sheet detector provided upstream of the secondary sheet feeder for detecting the recording sheet fed by the primary sheet feeder; and (d) a controller for controlling the primary sheet feeder and the secondary sheet feeder;

wherein the controller selects either a long or a short sheet feed interval of a feed start timing between a preceding recording sheet and a following recording sheet, according to a detection signal of the recording sheet detector, and wherein the controller controls the secondary sheet feeder so that the recording sheet is fed at the long and short sheet feed intervals, and controls the first primary sheet feeder on the basis of the control of the secondary sheet feeder.

4. A sheet feeding method in an image forming apparatus, comprising:

(a) feeding a recording sheet from a sheet accommodation tray by a primary sheet feeder;

(b) conveying the recording sheet fed by the primary sheet feeder to an image forming position by a secondary sheet feeder;

(c) selecting either a long or a short feed interval for a feed start timing between a preceding recording sheet and a following recording sheet, when the recording sheet is fed to the image forming position, wherein when the preceding recording sheet is fed at an arrival time within a range on a faster side of fluctuation of a secondary sheet feed arrival time at which the preceding recording sheet arrives at the secondary sheet feeder, the following recording sheet is fed at the short sheet feed interval, and when the preceding recording sheet is fed at the arrival time outside the range on the faster side and within a range of allowable fluctuation, the following recording sheet is fed at the long sheet feed interval.

5. The sheet feed method of claim 4, further comprising detecting a leading edge of the recording sheet on an upstream side of the secondary sheet feeder, and controlling the recording sheet by secondary sheet feeder according to a leading edge detection signal.

6. The sheet feed method of claim 5, wherein the recording sheet is fed by the primary sheet feeder on the basis of the leading edge detection signal.

7. The sheet feed method of claim 6, wherein the primary sheet feeder is operated on the basis of an operation of the secondary sheet feeder.

* * * * *